United States Patent [19]

Chan

[11] 4,291,301

[45] Sep. 22, 1981

[54] REMINDER ALARM SYSTEM FOR PREVENTING MISLAYING OF PERSONAL ARTICLES

[76] Inventor: Han-Saw Chan, Room 1105, 185 Sung-Kang Rd., Taipei, Taiwan

[21] Appl. No.: 116,005

[22] Filed: Jan. 28, 1980

[51] Int. Cl.[3] ..... G08B 21/00

[52] U.S. Cl. ..... 340/568; 340/689; 340/686; 340/571

[58] Field of Search ..... 340/52 D, 524, 568, 340/571, 572, 666, 673, 674, 686, 689

[56] References Cited

U.S. PATENT DOCUMENTS

| | | | |
|---|---|---|---|
| 3,248,723 | 4/1966 | Miethe | 340/689 |
| 3,614,763 | 10/1971 | Yannuzzi | 340/689 |
| 3,885,576 | 5/1975 | Symmes | 340/689 |
| 3,906,478 | 9/1975 | Smey | 340/689 |

*Primary Examiner*—Alvin H. Waring

*Attorney, Agent, or Firm*—Maky, Renner, Otto & Boisselle

[57] ABSTRACT

Reminders applied to pocketable personal accompanyings such as lighters, pens, ballpens, or pocket calculators, etc. By equipping such objects with mercury-switch-triggered ultramicro buzzers on suitable portion insomuch that an absent-minded owner may be reminded to take them away leaving after having used such objects to avoid indiscreet loss.

4 Claims, 2 Drawing Figures

REMINDER ALARM SYSTEM FOR PREVENTING MISLAYING OF PERSONAL ARTICLES

BACKGROUND OF THE INVENTION

Nowadays some pocketable personal accompanyings are becoming more and more delicate, nobby and luxurious that it seems as if they were rather a representation of the social position and education level of their owner than some indispensible personal facilities as they originally functioned. With the development and progression of science and technolegy, such articles are further equipped with accessory fashinable scientific achievements to diversify their styles and to multiply their functions e.g. digital watch pens, lighter pens, calculator pens, digital-watch lighters, etc. has been known to the world hitherto.

Many people have the tendency to forget their personal articles after use which may incur considerable money loss in using the aforesaid, trivial yet costly modern personal accompanyings. Take examples for the widely used pens and lighters with quality and efficiency just above average, the price may range from dozens to hundreds dollars, not to mention those more luxurious, nobby ones. Thus a casual negligence may cause inexpiable rue not only because of the apparent value of such goods due to their market prices, but also that they may have particular meanings to the owners as a permanant souvenir or some corresponding things of which the value is inestimable.

With a view to secure the people, especially those absent-minded ones, from the vexation caused by their carelessness, an appropriate attachment of such articles to remind their keepers has become absolutely and urgently needed.

Accordingly, it is the principle object of the present invention to provide one kind of alarm devices affixed to the pocketable personal accompanyings, and particularly concerns one that is triggered by abnormal positioning to remind the user not to forget to take them along leaving after having used such articles.

It is another object of this invention to provide one kind of alarm devices for pocketable personal accompanyings composed of simply a few tiny component parts which occupy very little space after assembled hence greatly lower the cost of production and permit such device be conveniently and practically applied broadly to various kinds, styles, and types of pocketable personal accompanyings.

It is a further object of the invention to provide one kind of electronical reminders comprising such component parts as mercury cell, mercury switch, IC, miniature loudspeaker, buzzer, etc. whereof the mercury cell provides the requisite power source which is disconnected when the remindered article is duly positioned yet become connected by abnormal positioning to yield signal through the fuction of the IC, and the signal is made audible by the loudspeaker which emits a buzzing sound.

SUMMARY

The present invention relates to electronical reminders applied to the pocketable personal accompanyings, and more particularly concerns that installed on specified portions of such objects, and is characterized by that the alarm mechanism remains shut when the remindered objects are suitably positioned without the possibility of being left, yet can be triggered to attract the attention of the users when they are so unduly positioned that the users are liable to forget them to prevent unnecessary loss due to negligence.

Numerous other features, objects, and advantages of the invention will become apparent from the following specification when read in connection with the accompanying drawing in which;

DETAILED DESCRIPTION OF PREFERRED EMBODIMENTS

Figure 1:
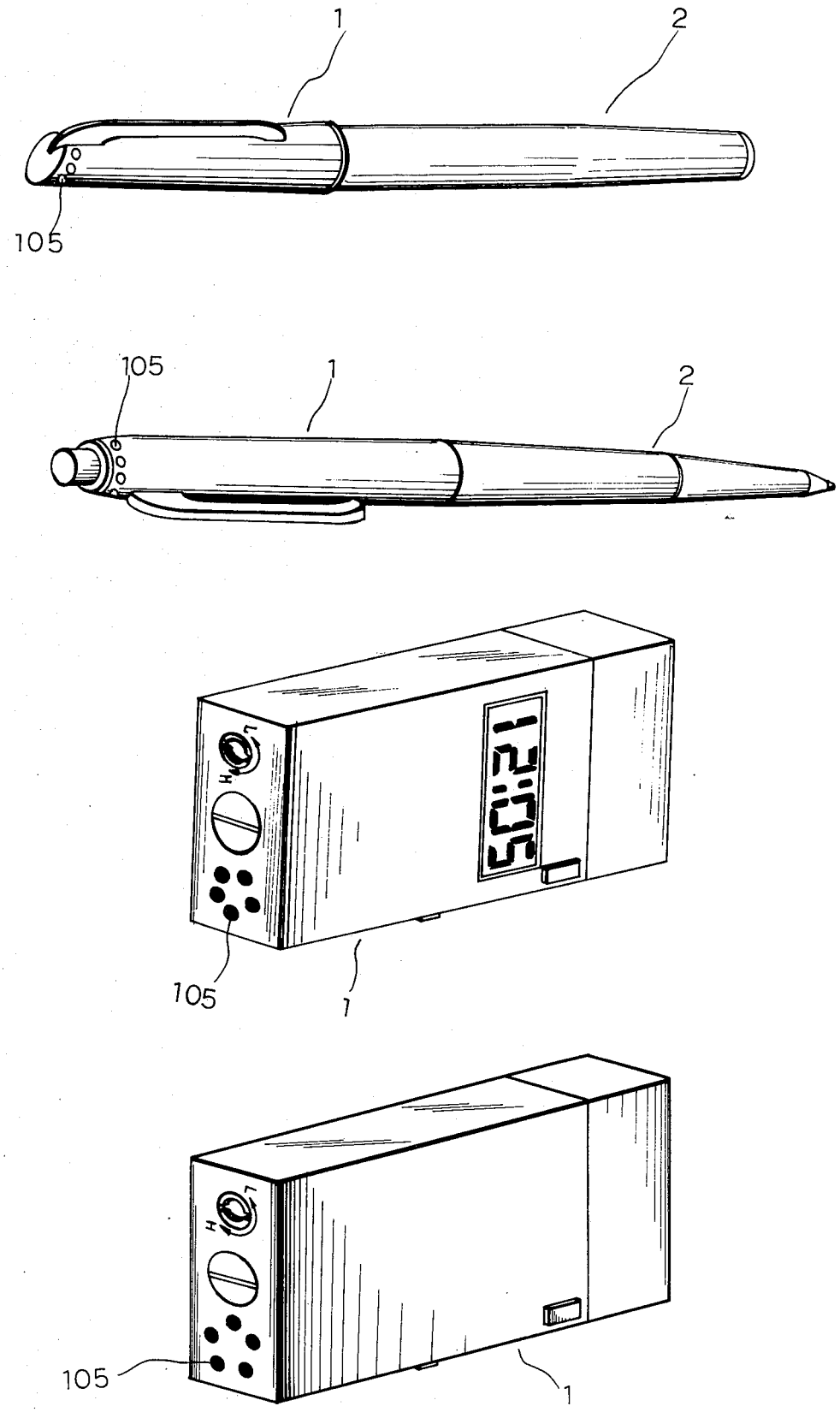
FIG. 1 is the embodiment of the present invention.

With reference now to the drawing and more particulary FIG. 1 thereof, there is shown four preferred, examplary, pocketable personal accompanyings, namely a pen, a ballpan, a digital-timer lighter, and an ordinary lighter, in which (1) is the very portion where the present invention is installed, and (2), the main part of the pen or lighter.

Figure 2:
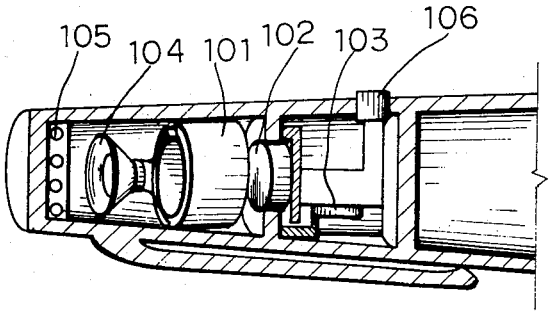
FIG. 2 is a graphical representation showing the structure of the present invention included in the examplary articles in FIG. 1.
Figure 2:
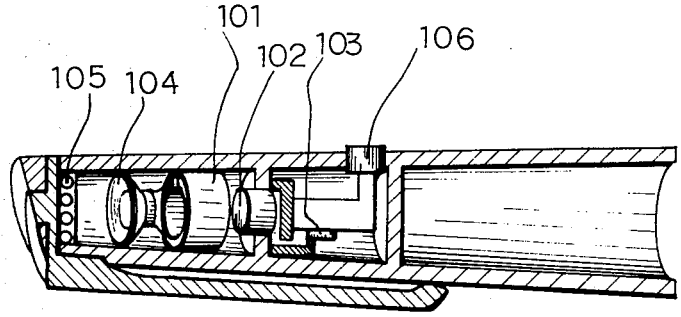
Figure 2:
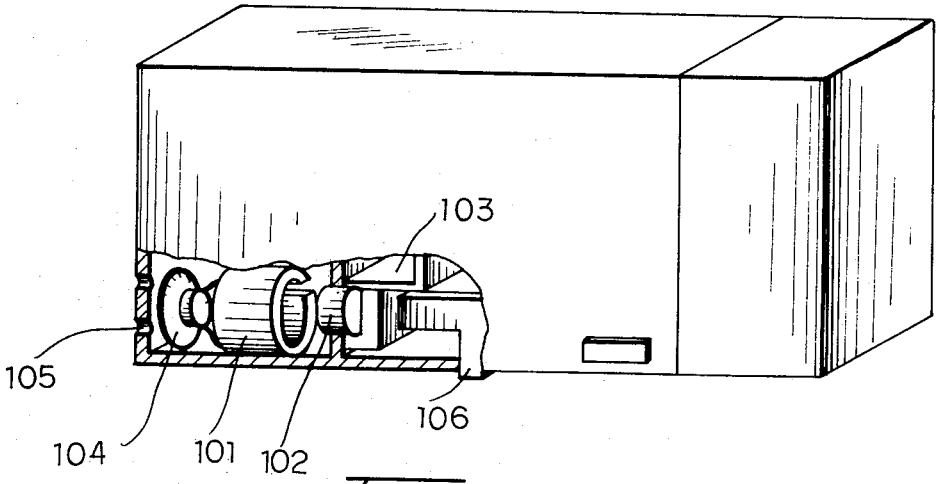

Referring to FIG. 2 in which part of the casing of the aforementioned articles is removed to reveal this invention therein, in which (101) is an IC of unstable oscillating circuit type frequently used, whereas (102) is a mercury cell of which the specification applied is preferably 6 V herein, (103) is the mercury switch that can be triggered by gravity when either the pen or the lighter is laid flat. A series of signals is thus yielded through the function of IC (101), and the signal is made audible by the miniature loudspeaker (104) which emits a broken, buzzing sound through the holes (105) in the casing.

Having briefly described the function of the present invention, it is further elucidated by the preferred embodiments of the pen and the lighter respectively as follow:

1. Applied to pens

The mercury switch stays shut all the time whenever it is held by user to write, or laid standing upright in the pocket when unused because the position of the pen is always kept vertical. Only when laid flat (the most probable candition for such case is that it is left on the desk due to the negligence of the user) can the gravity switch be triggered to remind its owner not to forget to take it along. Hence with the aid of this invention, can a most negligent person impossibly forget his own pens. An accessory equipment, namely shutting button (106) seen in FIG. 2, is used to stop all the function of the whole system under special circumstance when no alarm is wanted.

2. Applied to lighters

Like the pens, lighters are generally put in the pocket. However, unlike that of the formers, the position of the latters in the pocket is not always kept the same, therefore the whole alarming system must be in off condition so far as it is put in the pocket whatever the position of the lighter may be therein, standing, leaning, or resting. The switch that ends the off condition is attached to the flint lock, and is synchronously triggered together with the latter when the lighter is cocked to spark to light the soaked wick. Since the lighters are always kept upright when they are being used, the mercury switch persists shut. The most probable disposal of the lighters by ordinary user after use is either putting it back into the pocket, or laying it aside. In the former case, because of the uncertainty of the lighter's position in the pocket, the shutting butten provides to cease the function of the alarm system. In the latter case, unless the shutting button is pressed, the mercury switch can be triggered when the lighter leans to a considerable horizontal inclination, and start buzzing to remind the user to shut the alarm system and put the lighter back into his pocket. In case of continual use, the alarm function can be temporarily ceased to avoid the noise and the unnecessary consumption of electric power. The ceased alarm function recovers in the next use. Thus even a most absent-minded person finds it difficult to leave his lighter somewhere without taking away.

All the component parts involved in the present invention can be easily purchased in the market. Therefore the addition of the invention to the nobby articles scarcely raises the price because the cost of the former just seems so trivial in comparison with the costly luxuries in spite of its valuable contribution to the latters. The minimum size of the invention after assemblage ensure it to adapt well to miscellaneous small articles. In this regard, this invention is indeed a highly valuable masterpiece of industry.

It is evident that those skilled in this art may now make numerous uses and modifications of and departures from the specific embodiments described herein without departures from the specific inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. An electronic reminder for a usable personal article having a fixed general orientation during use thereof, said electronic reminder comprising a gravity activated position sensing switch, a battery, an electrically activated audio generator, and a compartment within said article for containing said position sensing switch, battery, and generator; which position sensing switch is for triggering the audio generator by a specified deviation of said article from said fixed general orientation; which usable personal article is a lighter; and said electronic reminder includes a switch attached to the lighter flintlock switch is triggered synchronously with the flintlock as the flintlock is cocked to light said lighter, and a shutting button; which flintlock switch is for switching the electronic reminder from an off-condition in which said position sensing switch cannot trigger said audio generator, to an on-condition in which said position sensing switch can trigger said audio generator, and which shutting button is for returning said electronic reminder from said on-condition to said off-condition.

2. An electronic reminder for a usable personal article having a fixed general orientation during use thereof, said electronic reminder comprising a gravity activated position sensing switch, a battery, an electrically activated audio generator, and a compartment within said article for containing said position sensing switch, battery, and generator; which position sensing switch is for triggering the audio generator by a specified deviation of said article from said fixed general orientation; which usable personal article is a pen; and said electronic reminder includes a shutting button for switching said electronic reminder from an on-condition in which said position sensing switch can trigger said audio generator to an off-condition in which said position sensing switch cannot trigger said audio generator.

3. An electronic reminder in accordance with claims 1 or 2 in which said specified deviation is a substantially horizontal orientation.

4. An electronic reminder in accordance with claims 1 or 2 in which said gravity activated position sensing switch is a mercury switch, and said audio generator includes an IC oscillator and a miniature loudspeaker.

* * * * *